US005102425A

United States Patent [19]

Buhler et al.

[11] Patent Number: 5,102,425

[45] Date of Patent: Apr. 7, 1992

[54] PROCESS FOR THE DYEING AND PRINTING OF BLENDED FABRICS MADE OF POLYESTER AND NATURAL FIBRE MATERIALS WITH CYANO-HYDROXY-METHYL PYRIDONE, AZO DISPERSE DYE TO REDUCE STAINING

[75] Inventors: Ulrich Buhler, Alzenau; Klaus Hofmann, Frankfurt am Main; Margareta Boos, Hattersheim; Reinhard Kühn, Frankfurt, all of Fed. Rep. of Germany

[73] Assignee: Cassella Aktiengesellschaft, Frankfurt am Main, Fed. Rep. of Germany

[21] Appl. No.: 643,213

[22] Filed: Jan. 22, 1991

[30] Foreign Application Priority Data

Jan. 29, 1990 [DE] Fed. Rep. of Germany ..... 4002482

[51] Int. Cl.[5] ..... D06P 1/18; D06P 3/87

[52] U.S. Cl. ..... 8/532; 8/533; 8/543; 8/695; 8/917; 8/918; 8/922

[58] Field of Search ..... 8/532, 533, 695

[56] References Cited

U.S. PATENT DOCUMENTS 3,905,951 9/1975 Berrie et al. ..... 534/772
4,548,613 10/1985 Bode et al. ..... 8/638
4,808,568 2/1989 Gregory et al. ..... 8/471

FOREIGN PATENT DOCUMENTS 4000529 7/1991 Fed. Rep. of Germany .
61-019664 1/1986 Japan .
1516037 6/1978 United Kingdom .

*Primary Examiner*—A. Lionel Clingman
*Attorney, Agent, or Firm*—Connolly and Hutz

[57] ABSTRACT

The present invention relates to a process for the dyeing and printing of blended fabrics made of polyester and natural fibre materials, characterized in that the polyester portion of the blended fabric is dyed and printed using one or more disperse dyes of the general formula I

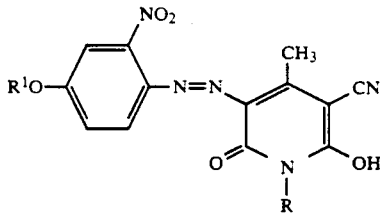

(I)

in which

R is methyl, ethyl or alkyl having 2 or 3 C atoms, which is substituted by alkoxy having 1 to 3 C atoms, and $R^1$ is alkyl having 1 to 3 atoms.

7 Claims, No Drawings

PROCESS FOR THE DYEING AND PRINTING OF BLENDED FABRICS MADE OF POLYESTER AND NATURAL FIBRE MATERIALS WITH CYANO-HYDROXY-METHYL PYRIDONE, AZO DISPERSE DYE TO REDUCE STAINING

The invention relates to a process for the dyeing and printing of blended fabrics made of polyester and natural fibre materials, characterised in that one or more disperse dyes of the general formula I

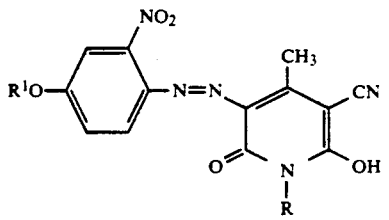

(I)

in which

R is methyl, ethyl or alkyl having 2 or 3 C atoms, which is substituted by alkoxy having 1 to 3 C atoms, and $R^1$ is alkyl having 1 to 3 C atoms, are used.

When dyeing and printing polyester/cellulose or polyester/wool blended fabrics, the polyester portion of the blended fabric is usually dyed or printed with disperse dyes and the cellulose or wool portion with reactive, direct, developing, leuko vat ester, vat, sulphur vat or sulphur dyes.

The difficulty with these processes is the proportion of disperse dye which in the dyeing of the polyester portion is not completely transferred to it but remains on the cellulose or wool fibre staining it, which has an adverse effect on the brilliance of the dyeing and its fastness properties. The dye remaining there has a different and duller shade than the one dissolved in the polyester fibre. This has an adverse effect in particular in the case of light or brilliant dyeings. Owing to its unsatisfactory affinity for cellulose or wool fibres, it also impairs the wet, rub and light fastness properties of the dyeing. This shows itself, for example in subsequent washing operations, for example the household wash of the consumer, in the fact that disperse dye repeatedly comes off and stains adjacent fabric of other colours or even white colour. This is a particular problem with strong dyeings which can only be obtained by using excess dye, with dyeings in which the cellulose or wool portion should remain unstained or with prints in which printed areas of different colours or else printed and unprinted areas are present.

This problem is in general counteracted by additional washing of the dyeing in which the staining particles are removed from the fabric. This washing operation is time-consuming and costly. Since the additional washing of the dyeing is carried out at temperatures close to the dyeing temperature, any disperse dye which enters the washing liquor may irreversibly stain the polyester portion. If the subsequent clearing is carried out reductively or oxidatively or if the dyeing of the cellulose portion is carried out in a reducing medium, the staining disperse dye is destroyed, which may give rise to cleavage products which in turn stain again.

The dyes of the general formula I are generally known as dyes for producing brilliant orange dyeings of high fastness level or as dyes which can be used as the yellow component of high colour strength in dye mixtures for black, brown, olive and other shades, and are described, for example, in German Patent 1,932,806.

The dye of the formula I in which R is hydrogen and $R^1$ is methyl is commercially available as C.I. Disperse Orange 151 and is used for the dyeing of polyester blended fabric.

Surprisingly, it has now been found that the dyes to be used according to the invention when used for the dyeing of polyester/wool and in particular polyester/cellulose blended fabric produce substantially less staining of the natural fibre portion than, for example, C.I. Disperse Orange 151.

In the general formula I, R is preferably ethyl or alkyl having 2 or 3 C atoms, which is substituted by alkoxy having 1 to 3 C atoms. Examples of these radicals are ethyl, 2-methoxyethyl, 2-ethoxyethyl, 2-n-propoxyethyl, 2-i-propoxyethyl, 3-methoxypropyl, 3-ethoxypropyl, 3-n-propoxypropyl and 3-i-propoxypropyl.

R is particularly preferably ethyl or n-propyl substituted in the 3-position by alkoxy having 1 to 3 C atoms.

A preferred radical $R^1$ is methyl.

Very particularly preferably, R is ethyl and $R^1$ is methyl. The dyes of the general formula I are known and can be prepared by known processes. The polyester portion of the polyester/cellulose or polyester/wool blended fabric can be dyed with disperse dyes by the so-called exhaust method under HT conditions or at the boiling temperature with the addition of carriers, and the cellulose or wool portion of the blended fabric can be dyed with reactive, direct, developing, vat, leuko vat ester, sulphur vat and sulphur or reactive and direct dyes from an aqueous liquor. However, the dyes can also be applied to the fibre by the so-called continuous process by impregnating the fabric with an aqueous padding liquor containing these dyes and then fixing these dyes on the fibre by thermosoling, steaming or so-called air passage. In this process, it is in principle possible to pad the polyester portion and cellulose or wool portion with the dyes together or else separately.

By means of a separate padding liquor, it is possible to apply chemicals, such as, for example, alkali and reducing agents to the fabric during dyeing. The alkali fixes the reactive dye on the cellulose or wool fibre by a chemical reaction, while the reducing agent converts the vat or sulphur vat dye into a form having affinity for the cellulose fibre.

When printing the blended fabric, the disperse dye in the polyester fibre which is applied to the fabric by means of a print paste is fixed by HT vapour, high-pressure vapour or dry heat.

It is in principle possible to dye the polyester portion and then the cellulose or wool portion. However, it is also possible to do it the other way round by first dyeing the cellulose or wool portion and only then the polyester portion.

Furthermore, there are dyeing processes in which the dyeing is carried out in one or two baths or in one or two steps. Detailed information on individual processes can be found, for example, in Melliand Textilberichte, 61, 261 (1980); Melliand Textilberichte 64, 290, 357 (1983) and Chemiefasern/Textilindustrie 1974, 756.

The dyes to be used according to the invention are used to print and preferably dye preferably polyester/cellulose and in particular polyester/cotton blended fabric.

The cellulose portion is preferably dyed with sulphur or vat dyes, but in particular with reactive dyes. A particularly preferred process is one in which the polyester portion is dye in the so-called thermosol process and the cellulose portion with a reactive dye, in particular the polyester portion being dyed first.

The dyes of the general formula I can also be used in the process according to the invention in mixtures with one another and/or in combination with other disperse dyes.

In the dyeing liquors and print pastes used for the above applications, the dyes or dye mixtures should be present in a very finely divided form.

The dyes are finely divided in a conventional manner by slurrying the synthesised dye together with dispersants in a liquid medium, preferably water, and subjecting the slurry to the action of shearing forces, as a result of which the dye particles originally present are mechanically reduced in size to such an extent as to maximise the specific surface area and minimise sedimentation of the dye. The particle sizes of the dyes are in general between 0.5 and 5 μm, preferably about 1 μm.

The dispersants used in the milling can be nonionic or anionic. Nonionic dispersants are for example reaction products of alkylene oxides, e.g. ethylene oxide or propylene oxide, with alkylatable compounds, for example fatty alcohols, fatty amines, fatty acids, phenols, alkylphenols and carboxamides. Examples of anionic dispersants are lignosulphonates, alkanesulphonates, alkylarylsulphonates or alkylaryl polyglycol ether sulphates.

The dye preparations thus obtained should be pourable for most applications. For this reason, the dye and dispersant content is limited in these cases. In general, the dispersions are standardised to a dye content of up to 50% by weight and a dispersant content of up to about 25%. For economic reasons, dye contents are usually not less than 15% by weight.

The dispersions may also contain further auxiliaries, for example auxiliaries which act as oxidising agents, e.g. sodium m-nitrobenzenesulphonate, or fungicides, e.g. sodium o-phenylphenolate and sodium pentachlorophenolate.

The dye dispersions thus obtained are very advantageously used for making up print pastes and dyeing liquors. They offer particular advantages for example in continuous processes, when the dye concentration of the dyeing liquors must be kept constant by a continuous feed of the dye into the running apparatus.

For certain applications, it is preferable to use pulverulent formulations. These powders contain the dye or dye mixture, a dispersant and other auxiliaries, for example wetting, oxidising, preserving and dustproofing agents.

A preferred method for preparing pulverulent dye formulations comprises stripping above-described liquid dye dispersions of the liquid content, for example by vacuum-drying, freeze-drying or drying on drum driers, but preferably by spray-drying.

To prepare a dyeing liquor, the necessary amount of a dye formulation prepared as described above is diluted with a dyeing medium, preferably water, to such an extent as to produce a liquor ratio of 5:1 to 50:1 for the dyeing. In general, further dyeing auxiliaries, such as dispersants, wetting agents and fixing agents are also added to the liquor.

If the dye or dye mixture is to be used for textile printing, the necessary amount of the dye formulation is kneaded together with a thickener, for example an alkali metal alginate or the like, and possibly other additives, for example fixation accelerants, wetting agents and oxidising agents, to form a print paste.

In the process according to the invention, the dyes and dye mixtures are preferably used in the form of liquid preparations.

In order to illustrate the inventive idea, a few dyeing examples are listed below.

EXAMPLE 1

30 g of a liquid preparation containing 25% of pure dye of the general formula I, in which R is ethyl and $R^1$ is methyl, are stirred into a padding liquor together with 15 g of a commercially available antimigration agent and 2 g of monosodium phosphate in such a manner that the final volume is 1 liter. This padding liquor is used to impregnate a 65:35 polyester/cotton blended fabric at 25° C., which is then squeezed off to a liquor pick up of about 65%, predried in an infrared drier for about 30 seconds, dried at 110° C. for 60 seconds, and the disperse dye is fixed in the polyester fibre at 210° C. for 60 seconds.

The predried blended fabric is then subjected to the dyeing conditions of a subsequent reactive dyeing, however in the absence of dye. To this end, the blended fabric is padded at 25° C. with a chemical bath containing 240 g/liter of common salt, 15 g/liter of sodium carbonate, 11.3 g/liter of a 50% strength sodium hydroxide solution and 4 g/liter of an oxidising agent based on a benzenesulphonic acid derivative, squeezed off to a liquor pick up of 90-100% and steamed at 102°-105° C. for 45 seconds. Finally the blended fabric is rinsed in hot water and dried.

A comparison dyeing in which the dye of the general formula I in which R is ethyl and $R^1$ is methyl is replaced by the dye of the general formula I in which R is hydrogen and $R^1$ is methyl gives a substantially duller result.

The effect can be illustrated by dissolving the cotton portion of the blended fabric after the dyeing using sulphuric acid. The remaining polyester portion, if the dye to be used according to the invention is use,, is dyed much more brilliantly than if commercially available dyes are used.

If pure cotton, for example cotton poplin, is impregnated with the padding liquor, fixed and aftertreated as described above, the substrate has orange stains if commercially available dyes are used, but is pure white if the dyes to be used according to the invention are used.

If the dye used in Example 1 is replaced by one or more of the ones listed in the table below, the same good results are obtained.

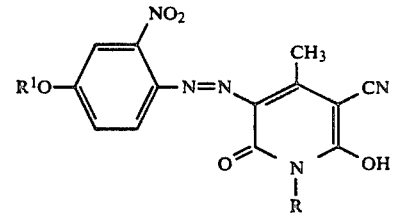

| Example | R | $R^1$ |
|---|---|---|
| 2 | $CH_3$ | $CH_3$ |
| 3 | $(CH_2)_2OCH_3$ | $CH_3$ |
| 4 | $(CH_2)_2OC_2H_5$ | $CH_3$ |
| 5 | $(CH_2)_2OiC_3H_7$ | $CH_3$ |
| 6 | $(CH_2)_2OnC_3H_7$ | $CH_3$ |
| 7 | $(CH_2)_3OCH_3$ | $CH_3$ |

-continued

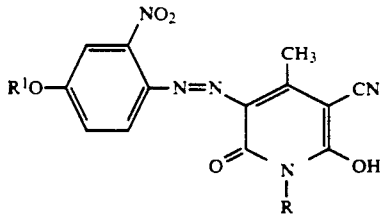

| Example | R | $R^1$ |
|---|---|---|
| 8 | $(CH_2)_3OC_2H_5$ | $CH_3$ |
| 9 | $(CH_2)_3OiC_3H_7$ | $CH_3$ |
| 10 | $(CH_2)_3OnC_3H_7$ | $CH_3$ |
| 11 | $CH_3$ | $C_2H_5$ |
| 12 | $C_2H_5$ | $C_2H_5$ |
| 13 | $(CH_2)_2OCH_3$ | $C_2H_5$ |
| 14 | $(CH_2)_2OC_2H_5$ | $C_2H_5$ |
| 15 | $(CH_2)_2OiC_3H_7$ | $C_2H_5$ |
| 16 | $(CH_2)_2OnC_3H_7$ | $C_2H_5$ |
| 17 | $CH_3$ | $nC_3H_7$ |
| 18 | $(CH_2)_2OCH_3$ | $nC_3H_7$ |
| 19 | $(CH_2)_2OC_2H_5$ | $nC_3H_7$ |
| 20 | $(CH_3)_3OCH_3$ | $nC_3H_7$ |
| 21 | $CH_3$ | $iC_3H_7$ |
| 22 | $(CH_2)_3OCH_3$ | $iC_3H_7$ |
| 23 | $(CH_2)_3OC_2H_5$ | $iC_3H_7$ |

We claim:

1. Process for the dyeing and printing of blended fabrics made of polyester and natural fibre materials, with one or more disperse dyes wherein the dyes consist essentially of dyes of the general formula I

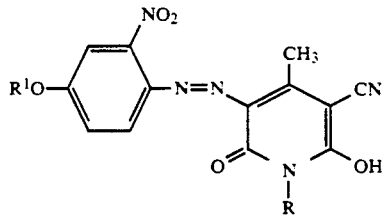

(I)

in which

R is methyl, ethyl or alkyl having 2 to 3 C atoms, which is substituted by alkoxy having 1 to 3 C atoms, and $R^1$ is alkyl having 1 to 3 C atoms.

2. Process according to claim 1 characterized in that $R^1$ is methyl.

3. Process according to claim 1 characterized in that R is ethyl or alkyl having 2 or 3 C atoms, which is substituted by alkoxy having 1 to 3 C atoms.

4. Process according to claim 1 characterized in that R is ethyl or n-propyl substituted in the 3-position by alkoxy having 1 to 3 C atoms.

5. Process according to claim 1 characterized in that R is ethyl and $R^1$ is methyl.

6. Process according to claim 1 wherein the natural fibre material is cellulose and the polyester portion of the blended fabric is dyed by the thermosol process and the cellulose portion is then dyed with reactive dyes.

7. Process according to claim 1 characterized in that the dyes are use din the form of a liquid preparation.

* * * * *